US005947392A

United States Patent [19]

Molnar et al.

[11] Patent Number: 5,947,392

[45] Date of Patent: Sep. 7, 1999

[54] TWO-COMPONENT METERING AND MIXING SYSTEM FOR ELECTRICALLY CONDUCTIVE COATING MATERIAL

[75] Inventors: Julius J. Molnar, Amherst; Rick Becker, Lorain, both of Ohio

[73] Assignee: Noroson Corporation, Westlake, Ohio

[21] Appl. No.: 08/928,209

[22] Filed: Sep. 12, 1997

[51] Int. Cl.[6] ..... B05B 5/00

[52] U.S. Cl. ..... 239/690; 239/691; 239/708

[58] Field of Search ..... 239/690, 691, 239/695, 708, 302–304, 398, 407

[56] References Cited

U.S. PATENT DOCUMENTS

| | | | |
|---|---|---|---|
| 3,240,225 | 3/1966 | Barrows | 137/240 |
| 3,315,899 | 4/1967 | Quarve | 239/586 |
| 3,747,850 | 7/1973 | Hastings et al. | 239/3 |
| 3,864,603 | 2/1975 | Kozinski et al. | 317/9 R |
| 3,895,748 | 7/1975 | Klingenberg | 222/571 |
| 3,906,122 | 9/1975 | Krause et al. | 427/33 |
| 3,929,286 | 12/1975 | Hastings et al. | 239/3 |
| 3,937,400 | 2/1976 | Krause | 239/11 |
| 3,971,337 | 7/1976 | Hastings | 118/629 |
| 3,999,691 | 12/1976 | Doom | 222/330 |
| 4,004,717 | 1/1977 | Wanke | 222/255 |
| 4,017,029 | 4/1977 | Walberg | 239/15 |
| 4,020,866 | 5/1977 | Wiggins | 137/592 |
| 4,053,012 | 10/1977 | Farmer | 164/254 |
| 4,085,892 | 4/1978 | Dalton | 239/15 |
| 4,124,163 | 11/1978 | Siegmann | 239/533.15 |
| 4,142,707 | 3/1979 | Bjorklund | 251/77 |
| 4,232,055 | 11/1980 | Shaffer | 427/33 |
| 4,275,834 | 6/1981 | Spanjersberg et al. | 239/3 |
| 4,313,475 | 2/1982 | Wiggins | 141/18 |
| 4,489,893 | 12/1984 | Smead | 239/691 |
| 4,544,570 | 10/1985 | Plunkett et al. | 427/27 |
| 4,629,119 | 12/1986 | Plunkett et al. | 239/63 |
| 4,629,164 | 12/1986 | Sommerville | 239/690 |
| 4,657,047 | 4/1987 | Kolibas | 137/881 |
| 4,660,598 | 4/1987 | Butterfield et al. | 137/510 |
| 4,771,729 | 9/1988 | Planert et al. | 118/697 |
| 4,792,092 | 12/1988 | Elberson et al. | 239/3 |
| 4,879,137 | 11/1989 | Behr et al. | 427/27 |
| 4,921,169 | 5/1990 | Tilly | 239/3 |
| 4,932,589 | 6/1990 | Diana | 239/3 |
| 5,078,168 | 1/1992 | Konieczynski | 137/566 |
| 5,083,711 | 1/1992 | Giroux et al. | 239/690 |
| 5,094,389 | 3/1992 | Giroux et al. | 239/690 |
| 5,197,676 | 3/1993 | Konieczynski et al. | 239/690 |
| 5,221,194 | 6/1993 | Konieczynski et al. | 417/430 |
| 5,249,748 | 10/1993 | Lacchia et al. | 239/690 |
| 5,328,093 | 7/1994 | Feitel | 239/304 |
| 5,538,186 | 7/1996 | Konieczynski | 239/690 |
| 5,549,755 | 8/1996 | Milovich et al. | 239/690 |
| 5,647,542 | 7/1997 | Diana | 239/690 |

FOREIGN PATENT DOCUMENTS

| | | | |
|---|---|---|---|
| 3725172 A1 | 2/1989 | Germany | B05D 1/04 |
| 51-54638(4) | 11/1974 | Japan | B05B 51/08 |
| WO 87/05832 | 10/1987 | WIPO | B05B 5/02 |

*Primary Examiner*—Andres Kashnikow
*Assistant Examiner*—Lisa Ann Douglas
*Attorney, Agent, or Firm*—Calfee, Halter & Griswold, LLP

[57] ABSTRACT

An apparatus for supplying a two-component, electrically conductive coating material which includes a first flow path for supplying a metered quantity of a catalyst from a source to a mixing device, a second flow path for applying a metered quantity of resin from a source to the mixing device, a third flow path for transferring the resulting two-component coating material from the mixing device to at least one coating dispenser which discharges electrostatically charged coating material onto a substrate, and, at least one voltage block device for maintaining a continuous voltage block between the electrostatically charged coating material and the sources of catalyst and resin.

14 Claims, 2 Drawing Sheets

TWO-COMPONENT METERING AND MIXING SYSTEM FOR ELECTRICALLY CONDUCTIVE COATING MATERIAL

FIELD OF THE INVENTION

This invention relates to systems for supplying electrically conductive coating material, and, more particularly, to an apparatus for combining metered quantities of a first component and a second component to form an electrically conductive coating material while maintaining a continuous voltage block between the sources of such components and a high voltage power supply.

BACKGROUND OF THE INVENTION

The application of coating materials using electrostatic spraying techniques has been practiced in industry for many years. In these applications, the coating material is discharged in atomized form, and an electrostatic charge is imparted to the atomized particles which are then directed toward a substrate maintained at a different potential to establish an electrostatic attraction for the charged, atomized particles. In the past, coating materials of the solvent-based variety, such as varnishes, lacquers, enamels and the like, were the primary materials employed in electrostatic coating applications. The problem with such coating materials is that they create an atmosphere which is both explosive and toxic. The explosive nature of the environment presents a safety hazard should a spark inadvertently be generated, such as by accidentally grounding the nozzle of the spray gun which can ignite the solvent in the atmosphere causing an explosion. The toxic nature of the workplace atmosphere created by solvent coating materials can be a health hazard should an employee inhale solvent vapors.

As a result of the concerns with solvent-based coatings, the recent trend has been to switch to water-based coating materials which reduce the problems of explosiveness and toxicity. Nevertheless, this switch to water-based type coatings has sharply increased the risk of electrical shock, which risk was relatively minor with solvent-based coatings. The problem of electrical shock has been addressed in U.S. Pat. Nos. 5,078,168; 5,197,676; and, a number of related patents owned by the assignee of this invention. In systems of the type disclosed in these patents, a "voltage block," i.e., an air gap, is provided between one or more sources of the conductive coating material and the electrostatically charged coating material which is directed to the coating dispensers. This voltage block ensures that there is never an electrical path between the source of water-based or other electrically conductive coating material, and the high voltage electrostatic power supply.

A variety of water-based, electrically conductive coating materials are commercially available which are suitable for use in voltage block systems of the type described above. In some applications, however, it is desirable to employ coating materials formed of the combination of two components, i.e., a catalyst and a resin. These two-component coating materials are produced by combining a metered quantity of the catalyst with a metered quantity of resin within a mixing device, and then discharging the intermixed components to one or more dispensers for application onto a substrate.

The same problems of explosiveness and toxicity mentioned above in connection with coating materials generally, apply to two-component coating materials formed by the combination of a resin and catalyst. This problem has been addressed by the development of water-based, two-component coating materials which reduce or eliminate problems of explosiveness and toxicity, but create the same problems of potential electrostatic shock as other water-based coatings when employed in electrostatic spraying systems. There has therefore been a need for an electrostatic spraying system capable of the formation of a water-based or electrically conductive, two-component coating material, which also reduces electrical shock hazard when employing electrostatic spraying techniques.

SUMMARY OF THE INVENTION

It is therefore among the objectives of this invention to provide an apparatus for supplying electrically conductive, two-component coating materials which accurately intermixes first and second components to form the two-component material, and, which maintains a continuous voltage block between the sources of the two components and a high voltage electrostatic source communicating with one or more dispensing devices.

These objectives are accomplished in an apparatus for supplying a two-component, electrically conductive coating material which includes a first flow path for supplying a metered quantity of a catalyst from a source to a mixing device, a second flow path for supplying a metered quantity of resin from a source to the mixing device, and, a third flow path for transferring the intermixed resin and catalyst, forming the two-component coating material, to at least one coating dispenser which discharges electrostatically charged coating material onto a substrate. One or more voltage block devices are located in the flow paths to maintain a continuous voltage block between the sources of resin and catalyst, and the electrostatically charged coating material discharged from the dispenser.

This invention is predicated upon the concept of supplying a two-component coating material, produced by the accurately metered combination of a resin and catalyst, in which one or more voltage block devices are located within the system in position to maintain a continuous voltage block between the sources of resin and catalyst and the electrostatically charged coating material discharged from one or more coating dispensers. In one presently preferred embodiment, a separate voltage block device is located in the catalyst flow path between the catalyst source and the mixing device, and, in the resin flow path between the resin source and the mixing device. The voltage block devices are operative to create a voltage block or air space between the catalyst and resin sources, and electrostatically charged coating material discharged from one or more coating dispensers, throughout operation of the apparatus. In an alternative embodiment, the voltage block devices within the catalyst flow path and resin flow path are eliminated and replaced with a single voltage block device located within the flow path between the outlet of the mixing device and one or more coating dispensers. This single voltage block device operates to maintain a continuous air gap between the resin and catalyst sources, and the electrostatically charged coating material, throughout operation of the system.

The catalyst flow path and resin flow path are similarly constructed. In each case, a metering gear pump receives the resin or catalyst from a piston pump connected to the respective sources, and transmits a metered quantity of catalyst or resin to the mixing device for combination therein. Both flow paths for the resin and catalyst operate at relatively low pressures, and are effective to accurately meter the flow of the relatively low viscosity resin and catalyst into the mixing device for combination therein to form the two-component coating material. In the embodiment of this invention wherein the voltage block device is located downstream from the mixing device, a piston pump associated with the voltage block device provides additional mixing of the resin and catalyst components therein prior to transfer to the coating dispensers.

DESCRIPTION OF THE DRAWINGS

The structure, operation and advantages of the presently preferred embodiments of this invention will become further apparent upon consideration of the following description, taken in conjunction with the accompanying drawings, wherein.

DETAILED DESCRIPTION OF THE INVENTION

Two alternative systems for supplying a two-component, water-based coating material are depicted in the Figs., and each are described separately below.

Figure 1:
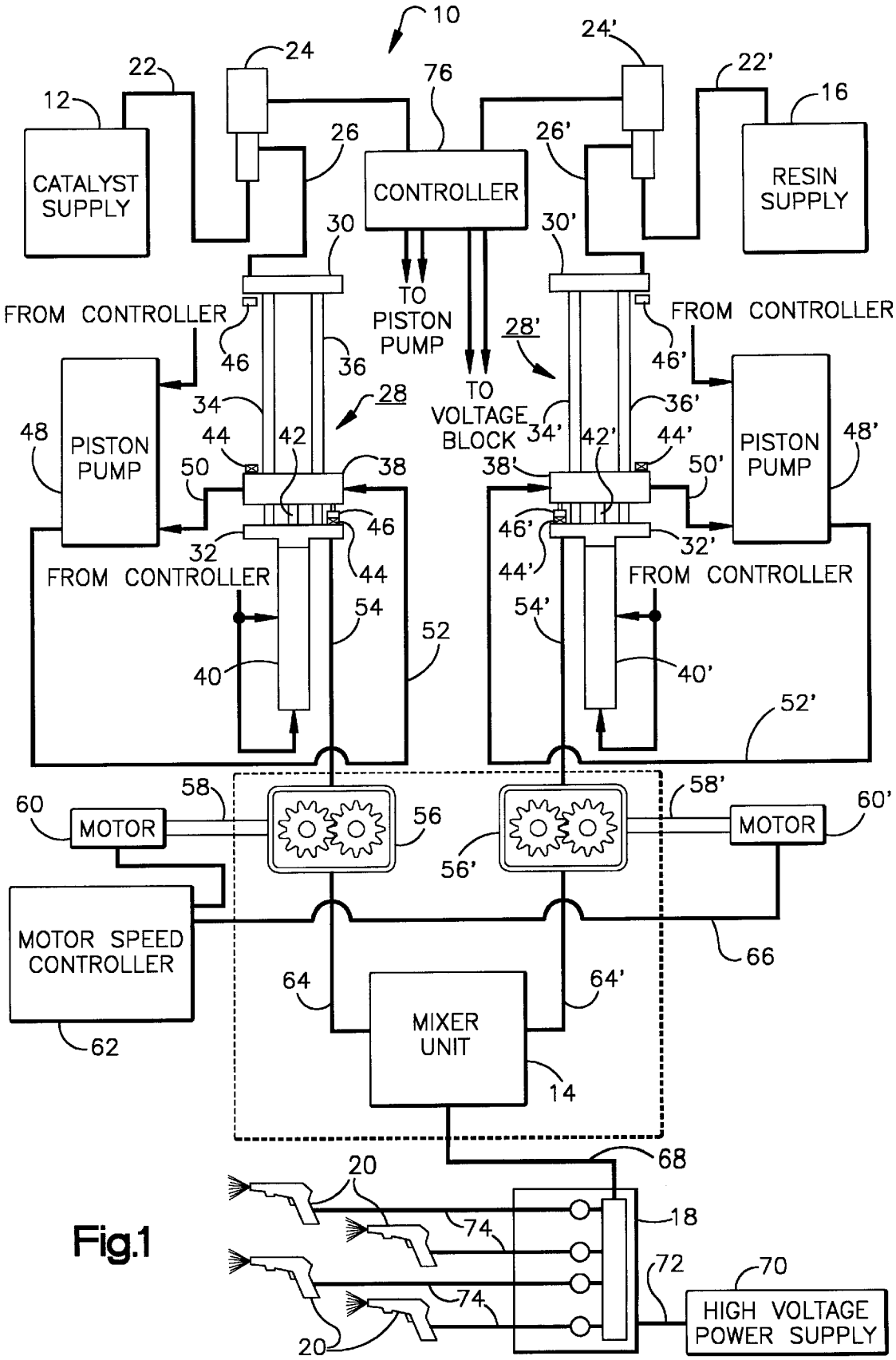
FIG. 1 is a schematic view of one embodiment of the two-component coating material supply system of this invention.

Embodiment of FIG. 1

Referring now to FIG. 1, one embodiment of a coating material supply apparatus 10 according to this invention is schematically depicted. The apparatus 10 comprises essentially a first flow path for the delivery of catalyst from a catalyst supply 12 to a mixing device 14, a second flow path for transmitting resin from a resin supply 16 to the mixing device 14, and, a third flow path extending between the mixing device 14 and a manifold 18 connected to one or more coating dispensers 20. Each of the flow paths is described separately below, followed by discussion of the overall operation of apparatus 10.

As shown on the left-hand portion of FIG. 1, the catalyst supply 12 is connected by a line 22 to a pump 24, which, in turn, is connected by an outlet line 26 to a voltage block device 28 of the type such as disclosed in U.S. Pat. No. 5,197,676, owned by the assignee of this invention, the disclosure of which is incorporated by reference in its entirety herein. The voltage block device 28 comprises a filling station 30 connected to a discharge station 32 by a pair of electrically nonconductive rods 34, 36. A shuttle 38 is axially slidable along the non-conductive rods 34, 36 between the filling station 30 and discharge station 32 by operation of a pneumatic cylinder 40. The pneumatic cylinder 40 has a non-conductive cylinder rod 42 connected to the shuttle 38 which is extendable to move the shuttle 38 to a filling position at the filling station 30, and retractable to transfer the shuttle to a discharge position at the discharge station 32.

In the presently preferred embodiment, the shuttle 38 carries a male coupling element 44 in position to engage a female coupling element 46 mounted to the filling station 30 which, in turn, is connected to the outlet line 26. The opposite side of shuttle 38 mounts a female coupling element 46 matable with a male coupling element 44 located at the discharge station 32. The detailed construction of coupling elements 44, 46 forms no part of this invention, and is disclosed in U.S. Pat. No. 5,078,168, owned by the assignee of this invention, the disclosure of which is hereby incorporated by reference in its entirety herein.

A large reservoir piston pump 48 is connected by a line 50 to the shuttle 38 at the male coupling element 44, and by a line 52 to the opposite side of shuttle 38 at the female coupling element 46. As described in more detail below, the piston pump 48 is operative to receive catalyst from the catalyst supply 12 during a filling operation, and then discharge the catalyst to the mixing device 14 for combination with the resin. The large reservoir, piston pump 48 can be of essentially any commercially available type, although the preferred construction is disclosed in U.S. patent application Ser. No. 08/633,693 now U.S. Pat. No. 5,727,931, entitled "Pump for Electrically Conductive Coating Material," filed Apr. 19, 1996 which is owned by the assignee of this invention. The detailed construction of the piston pump 48 forms no part of this invention and is therefore not described herein.

The discharge station 32 of voltage block device 28 is connected at the male coupling element 44 to a line 54 which leads to a metering gear pump 56. The metering gear pump 56 is drivingly connected by a nonconductive shaft 58 to a motor 60 operated by a motor speed controller 62. The outlet of the metering gear pump 56 is connected by a supply line 64 to the mixing device 14.

The second flow path, for the supply of resin to the mixing device 14, is shown on the right-hand portion of FIG. 1. This flow path is essentially identical in structure and function to that described above in connection with the catalyst, and therefore the same reference numbers are applied to the same structural elements with the addition of "'". The motor 60' is connected by a line 66 to the motor speed controller 62 for operation of the gear pump 56' as described in more detail below.

The outlet of the mixing device 14 is connected by line 68 to a manifold 18 of essentially any commercially available type. Preferably, coating material entering the manifold 18 is electrostatically charged by a high voltage power supply 70 connected to the manifold 18 by a line 72. The electrostatically charged coating material is distributed within manifold 18 to each of a number of discharge lines 74, which, in turn, connect to the coating dispensers 20.

The operation of apparatus 10 is governed by a controller 76, preferably connected to or internally including a source of pressurized air (not shown) which controls the various system elements via control lines depicted schematically in FIG. 1. The operation of apparatus proceeds as follows. Initially, the controller 76 operates the cylinders 40, 40' to extend the piston rods 42, 42' so that the shuttle 38 of voltage block device 28 moves to the filling station 30 and the shuttle 38' of voltage block device 28' moves to the filling station 30'. Catalyst from the catalyst supply 12 is directed by pump 24 through lines 22 and 26 to the filling station 30, and then through the mating coupling elements 44,46 into line 50 connected to piston pump 48. The piston pump 48 is filled with catalyst for transfer to the metering gear pump 56 as described below. Similarly, with the shuttle 38' at the filling station 30', the pump 24' transfers resin from the resin supply 16 through lines 22' and 26' to the filling station 30', through mating coupling elements 44', 46' and into the piston pump 48' via line 50'. The piston pump 48' is therefore filled with resin at the same time catalyst is introduced into the piston pump 48.

After the piston pumps 48 and 48' have been filled with catalyst and resin, respectively, the controller 76 operates the cylinders 40, 40' to move the shuttles 38 and 38' to their respective discharge stations 32 and 32'. A physical space or air gap is created between the shuttle 38 and the filling station 30, and, therefore, catalyst supply 12, with the shuttle 38 at discharge station 32. Similarly, an air gap is created between the shuttle 38' and resin supply 16, with the shuttle 38' positioned at filling station 30'. The controller 76 is effective to operate the piston pump 48 to a discharge catalyst therefrom through line 52, to the shuttle 38 and then through the discharge station 32 via coupling elements 44, 46 into the line 54. The supply of catalyst flowing through line 54 is delivered to the metering gear pump 56 which is operated by motor 60 and motor speed controller 62 to discharge a precisely metered quantity of catalyst from its outlet through line 64 into the mixing device 14. The resin is delivered in the same fashion to the mixing unit 14. With the shuttle 38' at the discharge position, resin is transferred from piston pump 48' through line 52', to the shuttle 38' and then through the discharge station 32' via coupling elements 44',46' into line 54'. The speed of the metering gear pump 56' is controlled by motor 60' and motor speed controller 62 to deliver the appropriate quantity of resin through line 64' and into the mixing device 14 for combination with the catalyst from catalyst supply 12. The two-component coating material produced from the combination of resin and catalyst within mixing device 14 is discharged from the outlet of mixing device 14 into line 68 and to the manifold 18 for distribution to the various coating dispensers 20.

When the piston pumps 48 and 48' are supplying the catalyst and resin to the mixing device 14, as described above, the controller 76 operates the high voltage power supply 70 to deliver an electrostatic charge to the manifold 18, which, in turn, charges the coating material flowing therein from mixing device 14. At the same time, a voltage block or air gap is maintained by the voltage block devices 28 and 28' between the catalyst supply 12 and resin supply 16, respectively, and the high voltage power supply 70. In this manner, the risk of electrostatic shock in the area of the supplies 12 and 16 is substantially eliminated.

After the quantity of catalyst and resin is exhausted from piston pumps 48 and 48', the controller 76 is operative to cause the cylinders 40 and 40' to return the shuttles 38, 38' to their respective filling stations 30, 30' in order to refill the pumps 48, 48'. The above-described process is then repeated.

Figure 2:
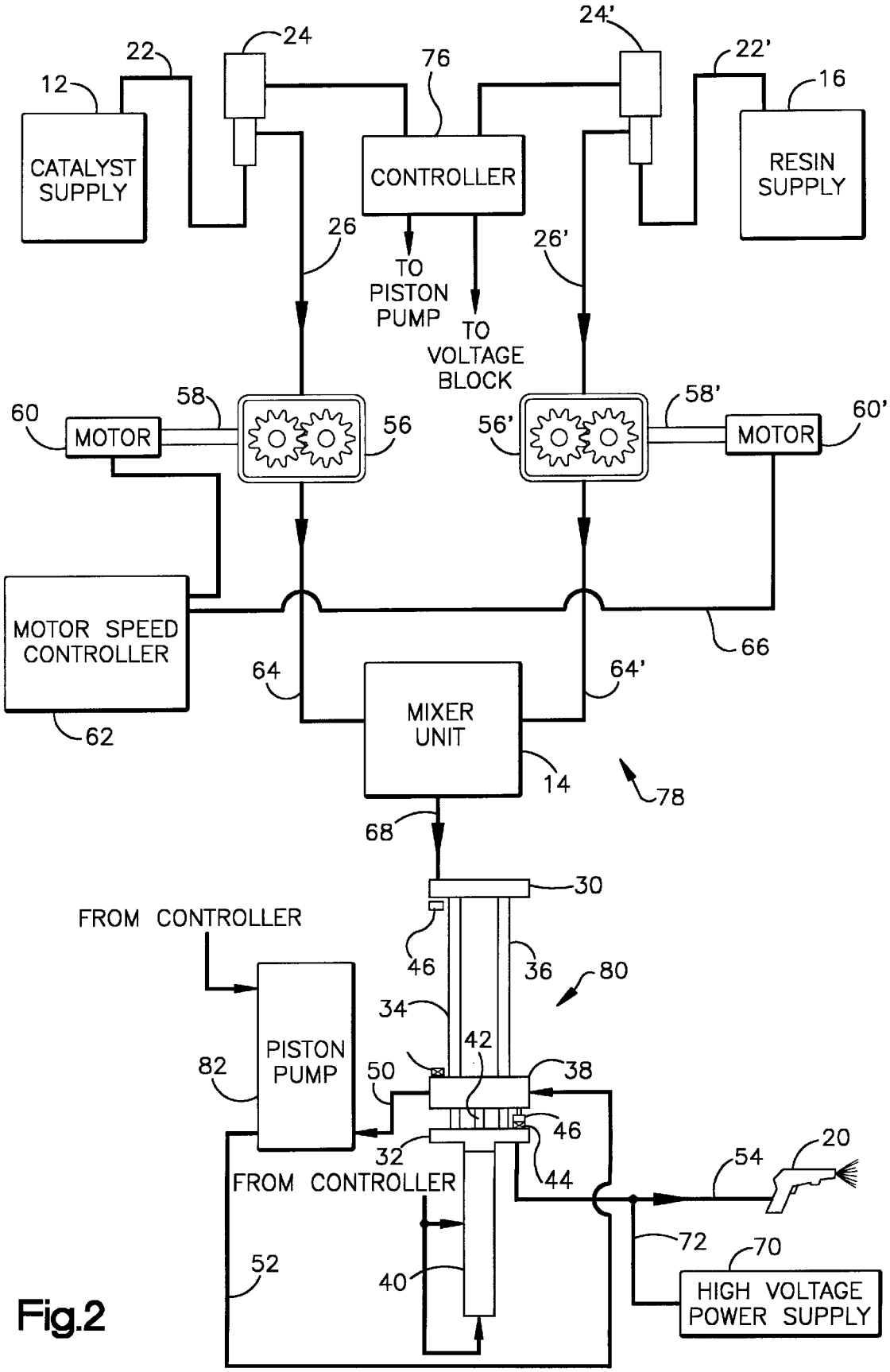
FIG. 2 is a schematic view of an alternative embodiment of the system herein.

Embodiment of FIG. 2

With reference now to FIG. 2, an alternative embodiment of an apparatus 78 according to this invention is schematically depicted. The apparatus 78 is similar in construction and operation to apparatus 10 in that a flow path is provided for the delivery of catalyst from a catalyst supply 12 to a mixing device 14, a second flow path is provided for the delivery of resin from a resin supply 16 to the mixing device 14, and, two-component coating material emitted from the mixing device 14 is transferred via a third flow path to one or more coating dispensers 20. For ease of reference, the same structural elements appearing in FIG. 2 within the catalyst and resin flow paths which are common to that of FIG. 1, are given the same reference numbers.

As shown at the top portion of FIG. 2, catalyst and resin are transmitted from their respective supplies 12 and 16 through metering gear pumps 56 and 56' into the mixing device 14. The metering gear pumps 56, 56' are structurally and functionally identical to those described above in connection with a discussion of FIG. 1.

The principal difference between the apparatus 78 of FIG. 2 and apparatus 10 of FIG. 1, is that the voltage block devices 28 and 28' and piston pumps 48, 48' within the catalyst and resin flow paths, respectively, of apparatus 10, are eliminated in the embodiment of FIG. 2. Instead, a voltage block device 80, and associated large reservoir piston pump 82, are located in the flow path between the outlet of the mixing device 14 and the coating dispenser 20. The construction and operation of voltage block device 80 is identical to that of voltage block devices 28, 28', and the same reference numbers are used to identify common structure.

As depicted in FIG. 2, the filling station 30 of voltage block device 80 is connected by line 68 to the mixing device 14. The connections between the piston pump 82 and voltage block device 80 are the same as that described above in connection with FIG. 1, except that the line 54 from the discharge station 32 of voltage block device 80 connects directly to the coating dispenser 20 in apparatus 76. Preferably, the high voltage power supply 70 is connected by line 72 to the coating material discharge line 54 from discharge station 32, but it is also contemplated that such connected could be made directly to dispenser 20, as desired.

The apparatus 78 operates in a manner similar to that of apparatus 10. The controller 76 is effective to cause pumps 24 and 24' to deliver catalyst and resin from supplies 12, 16, respectively, through lines 26, 26' to the metering gear pumps 56, 56'. The metering gear pumps 56, 56' are operated in the manner described above to deliver precisely metered quantities of catalyst and resin via lines 64 and 64' into the mixing device 14. The resulting two-component, electrically conductive coating material is discharged from mixing device 14 through line 68 to the filing station 30 of voltage block device 80. In order to initially fill the piston pump 82 with the two-component coating material, the voltage block device 80 is operated in the same manner described above in connection with a discussion of voltage block devices 28, 28'. Shuttle 38 is moved by operation of cylinder 40 to the filling station 30 so that the coating material from mixing device 14 can be delivered through the filling station 30 and mating coupling elements 44, 46 into the piston pump 82 via line 50. When the piston pump 82 is filled with the two-component coating material, the voltage block device 80 is operated to move the shuttle 30 to the discharge station 32 as shown in FIG. 2. In this position, a voltage block or air gap is provided between the filling station 30, and, hence, all of the elements of apparatus 78 upstream therefrom, and the discharge station 32 which is electrically connected to the high voltage power supply 70 via lines 54 and 72. Two-component coating material is discharged from piston pump 82 through line 52, to shuttle 30 and then through the discharge station 32 via mating coupling elements 44, 46 into the line 54 leading to dispenser 20. While only one dispenser 20 is shown in FIG. 2, multiple dispensers 20 could be employed as illustrated in FIG. 1. The coating material is electrostatically charged within line 54 through its connection to power supply 70 via line 72. The coating process proceeds until the supply of two-component coating material within piston pump 82 is exhausted, at which time the controller 76 is operative to cause the shuttle 38 to return to filling station 30 where the process of filling piston pump 82 described above is repeated. During the filling operation of piston pump 82, an air gap is maintained between the discharge station 32, and, hence the high voltage power supply 70, and all other elements of apparatus 78.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, while a shuttle-type voltage block is illustrated in the Figs., including mateable coupling elements, it should be understood that essentially any voltage block device could be employed within the flow paths described above. As such, the term "voltage block device" in the context of this invention is meant to refer to a device capable of interrupting the electrical path between the charged electrostatic coating material and the sources of catalyst or resin. Additionally, although metering gear pumps are depicted in the Figs., it is contemplated that other devices capable of delivering a metered quantity of catalyst and resin to the mixing device would be suitable for use in the resin and catalyst flow paths herein.

FIGS. 1 and 2 illustrate alternative embodiments of a system for intermittently supplying a two-component, electrically conductive coating material to one or more dispensers. The operation of such systems is "intermittent" in the sense that the coating material cannot be supplied to the dispenser(s) continuously while maintaining a constant voltage block between the sources of catalyst and resin, and the charged coating material. When each piston pump 48, 48' or 82 is emptied of catalyst, resin or coating material, flow is terminated until such pumps are refilled as discussed in detail above. A voltage block system capable of continuously delivering coating material, while maintaining a continuous voltage block between the sources of resin and catalyst and the high voltage power supply is shown, for example, in U.S. Pat. No. 5,655,896, owned by the assignee of this invention, the disclosure of which is incorporated by reference in its entirety herein. In the system of the '896 patent, a combination of voltage block devices arranged in series and parallel are employed so that when one pump is being filled with coating material another pump(s) discharges coating material to the dispensers, while maintaining a continuous voltage block therebetween.

Therefore, it is intended that the invention not be limited to the particular embodiment disclosed as the best mode contemplated for carrying out this invention, but that the invention will include all embodiments falling within the scope of the appended claims.

We claim:

1. Apparatus for supplying a two-component, electrically conductive coating material, comprising:

a mixing device for combining a first component and a second component to form a two-component coating material;

a first flow path for supplying a metered quantity of the first component from a first source to said mixing device;

a second flow path for supplying a metered quantity of the second component from a second source to said mixing device;

a third flow path for transferring the two-component coating material from said mixing device to at least one coating dispenser, said third flow path including a hose directly connected to the coating dispenser;

a high voltage power supply which is effective to electrostatically charge the two-component coating material;

a voltage block device, located in at least one of said first and second flow paths, for maintaining a voltage block between said at least one of said first and second sources and the electrostatically charged two-component coating material.

2. The apparatus of claim 1 in which said first flow path includes a metering gear pump connected to said mixing device, said voltage block device being connected between said first source and said metering gear pump.

3. The apparatus of claim 1 in which said second flow path includes a metering gear pump connected to said mixing device, said voltage block device being connected between said second source and said metering gear pump.

4. The apparatus of claim 1 in which said first flow path includes a first piston pump connected to said voltage block device for receiving said first component from said first source and transmitting said first component to said mixing device.

5. The apparatus of claim 1 in which said second flow path includes a second piston pump connected to said voltage block device for receiving said second component from said second source and transmitting said second component to said mixing device.

6. The apparatus of claim 1 wherein said voltage block device includes:

a filling station which mounts a first coupling element;

a discharge station spaced from said filling station, said discharge station mounting a second coupling element; and a shuttle which mounts third and fourth coupling elements, said shuttle being movable between said filling station at which said third coupling element mates with said first coupling element and said discharge station at which said fourth coupling element mates with said second coupling element.

7. Apparatus for supplying a two-component, electrically conductive coating material, comprising:

a mixing device for combining a first component and a second component to form a two-component coating material;

a first flow path for supplying a metered quantity of the first component from a first source to said mixing device;

a second flow path for supplying a metered quantity of the second component for a second source to said mixing device;

a third flow path for transferring coating material from said mixing device to at least one coating dispenser;

a high voltage power supply which is effective to electrostatically charge the two-component coating material;

a voltage block device located in said third flow path for maintaining a continuous voltage block between said first and second sources, and the electrostatically charged two-component coating material.

8. The apparatus of claim 7 in which said first flow path includes a metering gear pump connected to said mixing device.

9. The apparatus of claim 7 in which said second flow path includes a metering gear pump connected to said mixing device.

10. The apparatus of claim 7 in which said third flow path includes a piston pump connected to said voltage block device, said piston pump receiving the two-component coating material from said mixing device and then transferring the two-component coating material to said at least one coating dispenser.

11. The apparatus of claim 7 in which said voltage block device includes:

a filling station which mounts a first coupling element;

a discharge station spaced from said filling station, said discharge station mounting a second coupling element; and a shuttle which mounts third and fourth coupling elements, said shuttle being movable between said filling station at which said third coupling element mates with said first coupling element and said discharge station at which said fourth coupling element mates with said second coupling element.

12. The method of supplying a two-component, electrically conductive coating material, comprising:

(a) transmitting a metered quantity of a first component along a first flow path from a first source to a mixing device;

(b) transmitting a metered quantity of a second component along a second flow path from a second source to the mixing device;

(c) intermixing the first and second components within the mixing device to form a two-component coating material;

(d) transferring electrostatically charged, two-component coating material along a third flow path from the mixing device to at least one coating dispenser; and (e) maintaining a voltage block between at least one of the first and second sources and the electrostatically charged two-component coating material.

13. The method of claim 12 in which step (e) comprises locating a first voltage block device within the first flow path and a second voltage block device within the second flow path.

14. The method of claim 12 in which step (e) comprises locating a voltage block device within the third flow path.

* * * * *